US008435070B2

(12) United States Patent
Curanovic

(10) Patent No.: US 8,435,070 B2
(45) Date of Patent: May 7, 2013

(54) METHOD AND APPARATUS FOR DISCONNECTING ELECTRICAL SERVICE

(75) Inventor: Viktor Curanovic, Yonkers, NY (US)

(73) Assignee: Consolidated Edison Company of New York, Inc., New York, NY (US)

( * ) Notice: Subject to any disclaimer, the term of this patent is extended or adjusted under 35 U.S.C. 154(b) by 167 days.

(21) Appl. No.: 13/112,638

(22) Filed: May 20, 2011

(65) Prior Publication Data

US 2012/0295474 A1 Nov. 22, 2012

(51) Int. Cl.
*H01R 33/945* (2006.01)

(52) U.S. Cl.
USPC ..... 439/517; 439/167

(58) Field of Classification Search ..... 439/517, 439/146, 167, 508; 361/662, 659, 668
See application file for complete search history.

(56) References Cited

U.S. PATENT DOCUMENTS 5,704,804 A * 1/1998 Robinson et al. ..... 439/517
5,853,300 A * 12/1998 Robinson et al. ..... 439/517
5,997,347 A * 12/1999 Robinson et al. ..... 439/517
6,475,028 B1 * 11/2002 Robinson et al. ..... 439/517
7,905,748 B2 * 3/2011 Benke ..... 439/517

* cited by examiner

*Primary Examiner* — Khiem Nguyen
(74) *Attorney, Agent, or Firm* — Cantor Colburn LLP

(57) ABSTRACT

According to an aspect of the invention, an apparatus for disconnecting electrical service includes a housing to be coupled to an electric meter socket, a first stationary connector protruding from a first side of the housing, the first stationary connector configured to connect to a first line of electricity and a second stationary connector protruding from the first side of the housing, the second stationary connector configured to connect to a second line of electricity. The apparatus also includes a first moveable connector coupled to the first side of the housing, a second moveable connector coupled to the first side of the housing, and a third moveable connector coupled to the first side of the housing.

14 Claims, 2 Drawing Sheets

METHOD AND APPARATUS FOR DISCONNECTING ELECTRICAL SERVICE

BACKGROUND OF THE INVENTION

The present invention relates generally to an adapter for an electrical meter, and more particularly to an adapter that allows for a relatively simple mechanism for disconnecting electrical service to both residential and commercial service locations.

Power may be disconnected at a customer's location based on any number of factors, such as due to safety issues, construction or for any other suitable reason. Electrical meters for commercial customers feature different connectors and lines than residential meters. Thus, a field technician or operator uses different equipment to disconnect service for a residential customer than is used to disconnect service for a commercial customer. Accordingly, the technician brings a variety of parts and equipment into the field to accommodate various situations.

SUMMARY OF THE INVENTION

According to an aspect of the invention, an apparatus for disconnecting electrical service includes a housing to be coupled to an electric meter socket, a first stationary connector protruding from a first side of the housing, the first stationary connector configured to connect to a first line of electricity and a second stationary connector protruding from the first side of the housing, the second stationary connector configured to connect to a second line of electricity. The apparatus also includes a first moveable connector coupled to the first side of the housing, a second moveable connector coupled to the first side of the housing, and a third moveable connector coupled to the first side of the housing.

According to another aspect of the invention, a method for disconnecting electrical service at a residential or commercial location includes removing an electric meter from a meter socket and adjusting an adapter to one of a first configuration for a commercial location or a second configuration for a residential location. The method also includes coupling the adapter to the meter socket, and coupling the electric meter to the adapter.

According to yet another aspect of the invention, an apparatus for disconnecting electrical service includes a housing to be coupled to an electric meter socket and first and second stationary connectors protruding from a first side of the housing, wherein the first and second stationary connectors each extend substantially perpendicular to the first side of the housing. The apparatus also includes a first moveable connector coupled to the first side of the housing, a second moveable connector coupled to the first side of the housing, and a third moveable connector coupled to the first side of the housing, wherein the first, second and third moveable connectors are each configured to be substantially flush with the first side of the housing in a retracted position and to extend substantially perpendicular to the first side of the housing in an extended position These and other advantages and features will become more apparent from the following description taken in conjunction with the drawings.

BRIEF DESCRIPTION OF THE DRAWINGS

Referring now to the drawings, which are meant to be exemplary and not limiting, and wherein like elements are numbered alike.

DETAILED DESCRIPTION OF THE INVENTION

Figure 1:
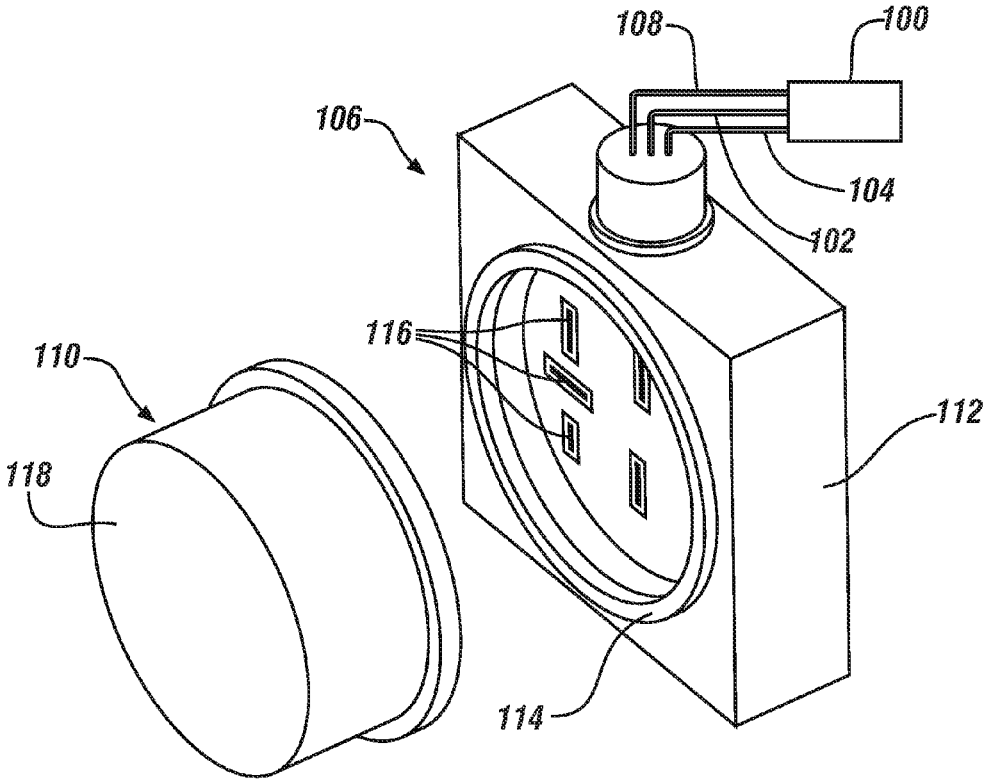
FIG. 1 is a perspective view of an exemplary power distribution system.

FIG. 1 is a perspective view of an embodiment of a power distribution system including a power source 100 that provides electrical power service to a residential or commercial building site (not shown) over two incoming line conductors 102, 104. The line conductors 102, 104 are connected to a standard electric watt-hour meter socket 106 (also referred to as "meter receptacle"). A neutral line conductor 108 also extends from the power source 100 to the meter socket 106. Typically, the meter socket 106 is mounted to the outer wall of the building or location of the customer. In order to measure the electrical power consumed by the building, a watt-hour meter 110 is removably attached to the meter socket 106.

The meter socket 106 includes a rectangularly-shaped panel or housing 112. A circular opening 114 is formed partially through the front end of housing 112, wherein a plurality of suitable electrical contacts or connectors, such as sockets 116, are mounted therein for being connected to a plurality of corresponding contacts (not shown) of the hour meter 110. For ease of engagement, the watt-hour meter 110 includes a housing 118 which corresponds in shape and size to the opening 114 of meter socket 106. The circuitry for measuring the electrical power consumption passing therethrough is housed within the watt-hour meter 110. In embodiments, residential customers typically have five contacts between the hour meter 110 and the meter socket 106. Commercial customers have seven contacts between the hour meter 110 and the meter socket 106. Accordingly, the arrangement and number of sockets 116 varies depending on the service at the location.

Figure 2:
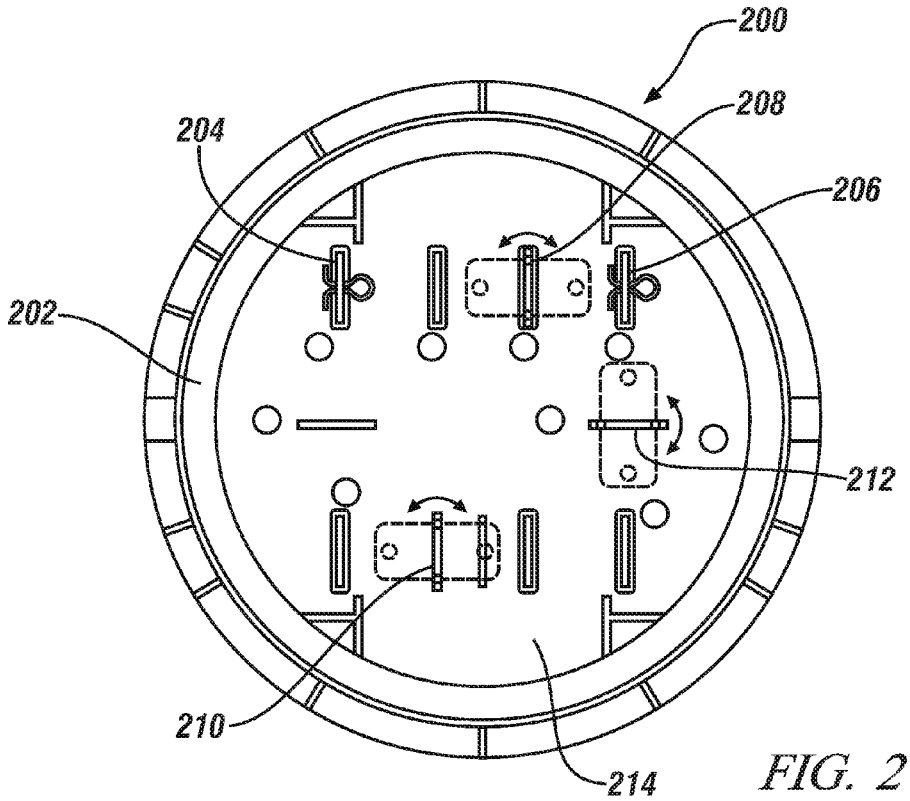
FIG. 2 is a back view of an adapter to be used with the system of FIG. 1.

FIG. 2 is a back view of an exemplary adapter 200 configured to be placed between the meter socket 106 and meter 110, shown in FIG. 1, to disconnect electrical service to the location or building. The exemplary adapter 200 allows a technician or operator to adjust the adapter 200 to disconnect service for either residential or commercial locations. The adapter 200 includes a housing 202 with a stationary connectors 204, 206 and moveable connectors 208, 210, 212. The stationary connectors 204, 206 are fixed conductors or jaws that protrude from a socket side 214 of the housing 202. Accordingly, the stationary connectors 204, 206 are configured to be received by a meter socket 106 for residential and commercial locations. In an embodiment, such as for use in a commercial location, the moveable connectors 210 and 212 are configured to connect to neutral lines in the meter socket 106, while the moveable connector 208 and stationary connectors 204 and 206 are configured to connect to electric lines in the meter socket 106.

The moveable connectors 208, 210 and 212 are configured to extend and retract, depending on the application for the adapter 200. For example, the moveable connector 208 is retracted or substantially flush with the surface of socket side 214 for an application such as at a residential location having five contacts. In addition, the moveable connector 210 is substantially flush with the surface of socket side 214 while the moveable connector 212 is extended for the residential location. For a commercial location, the moveable connectors 208 and 210 are extended while the moveable connector 212 is substantially flush with the surface of the socket side 214. Exemplary moveable connectors 208, 210 and 212 are hinged conductors or jaws configured to be locked in an extended or retracted position. In a locked extended position, the connectors protrude from the surface of the socket side 214 at a substantially perpendicular angle and perform similarly to the stationary connectors 204 and 206. In a retracted position, the connectors are substantially flush or do not protrude from the surface of the socket side 214. In an embodiment, the moveable connectors 208, 210 and 212 hinge and are configured to lock in the extended or retracted position by a suitable mechanism, such as a pins, collars, biasing members at the base or any other suitable mechanism. In an embodiment, the moveable connectors 208, 210 and 212 are biased to extend and retract through an opening in the surface of the socket side 214 and are locked into position via a suitable mechanism. As depicted, the conductor lines 102 and 104 are electricity lines that are routed to selected connectors or sockets 116. In addition, the neutral line 108 is connected to selected sockets 116 of the meter socket 106.

Figure 3:
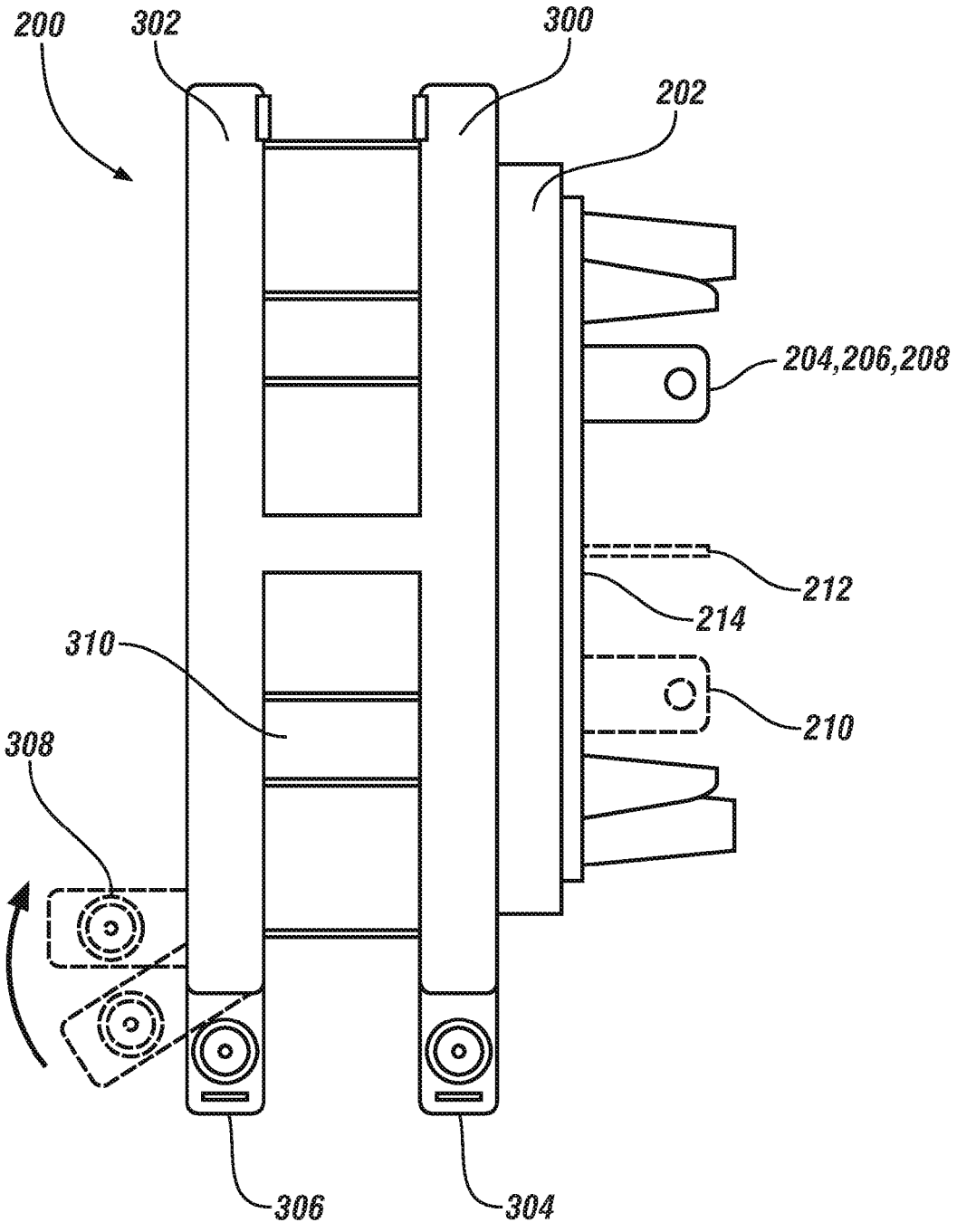
FIG. 3 is a side view of the adapter of FIG. 2.

FIG. 3 is a side view of the exemplary adapter 200. The adapter has rings 300 and 302 disposed circumferentially about the housing 202. The rings 300 and 302 have respective locking mechanisms 304 and 306 configured to secure the rings to the meter socket 106 and meter 110. The ring 302 and locking mechanism 306 enable movement of at least a portion of the locking mechanism 306 (also referred to as "adjustable locking mechanism") to a raised second position 308. As depicted, the second position 308 gives clearance for a front panel of the housing 112 to slide over the ring 302 during installation of the adapter 200 for an application such as at commercial locations, for example. In an embodiment, the front panel of the commercial meter socket 106 is removed before the meter 110 is removed. The adapter 200 is then placed on the meter socket 106 and the ring 300 and locking mechanism 304 are secured. The panel is then replaced on the meter 110 and meter socket 106 while the locking device 306 is in the second position 308. The locking device 306 is then be moved back to the original position (shown in solid lines) and secured to the meter 110 after the meter is inserted in the adapter 200. As depicted, the locking mechanism 304 is located inside the housing 112 when the adapter 200 is installed in commercial locations. In other embodiments, the rings 300 and 302, along with locking mechanisms 304 and 306, are located outside the housing 112 when the adapter 200 is installed. The service technician may have a custom key that is used to unlock the locking mechanisms 304 and 306. The locking mechanisms 304 and 306 are configured to secure the adapter 200 to the meter socket 106 and the 110 to prevent unauthorized removal of the adapter. In an embodiment, an indicator 310 is used to identify a status of the meter socket 106. The technician may perform one or more tests of the meter socket 106 and then change the status of the indicator 310. For example, the status may indicate to future technicians that the meter socket 106 has failed one or more tests. The technician may adjust the status of the indicator 310 by manually sliding the indicator to show a color corresponding to the status.

In an embodiment, the adapter 200 provides flexibility to an operator for disconnecting electrical service at either a residential or commercial location. The moveable connectors 208, 210 and 212 are adjustable for use of the adapter 200 for commercial or residential applications. In an embodiment, when the moveable connectors 208 and 210 are in an extended position, they are substantially parallel to the stationary connectors 204 and 206. In addition, when the moveable connector 212 is in the extended position, it is substantially perpendicular to the stationary connectors 204 and 206. The flexibility of the adapter 200 simplifies the equipment and components used by technicians at customer sites, thereby reducing overall cost and time spent planning and installing equipment for disconnecting of electrical service at at variety of different applications, such as residential and commercial locations, for example.

While the invention has been described with reference to exemplary embodiments, it will be understood that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. Apparatus for disconnecting electrical service, the apparatus comprising:

a housing to be coupled to an electric meter socket;

a first stationary connector protruding from a first side of the housing, the first stationary connector configured to connect to a first line of electricity;

a second stationary connector protruding from the first side of the housing, the second stationary connector configured to connect to a second line of electricity;

a first moveable connector coupled to the first side of the housing;

a second moveable connector coupled to the first side of the housing; and a third moveable connector coupled to the first side of the housing.

2. The apparatus of claim 1, wherein the first moveable connector is configured to connect to a third line of electricity when in an extended position.

3. The apparatus of claim 1, wherein the first, second and third moveable connectors are each configured to be substantially flush with the first side of the housing in a first position and to extend substantially perpendicular to the first side of the housing in a second position.

4. The apparatus of claim 1, wherein the first and second stationary connectors are substantially parallel to the first and second moveable connectors when the first and second moveable connectors are in an extended position.

5. The apparatus of claim 4, wherein the first and second stationary connectors are substantially perpendicular to the third moveable connector when the third moveable connector is in an extended position.

6. The apparatus of claim 4, wherein the first and second moveable connectors are in the extended position and the third moveable connector is in a retracted position for disconnecting electrical power at a commercial service location.

7. The apparatus of claim 4, wherein the first and second moveable connectors are in a retracted position and the third moveable connector is in the extended position for disconnecting electrical power at a residential service location.

8. The apparatus of claim 1, wherein the second and third moveable connectors are each configured to connect to a neutral line.

9. The apparatus of claim 1, wherein the housing is secured to the electric meter socket via a ring and adjustable locking mechanism.

10. An apparatus for disconnecting electrical service, the apparatus comprising:

a housing to be coupled to an electric meter socket;

first and second stationary connectors protruding from a first side of the housing, wherein the first and second stationary connectors each extend substantially perpendicular to the first side of the housing;

a first moveable connector coupled to the first side of the housing;

a second moveable connector coupled to the first side of the housing; and a third moveable connector coupled to the first side of the housing, wherein the first, second and third moveable connectors are each configured to be substantially flush with the first side of the housing in a retracted position and to extend substantially perpendicular to the first side of the housing in an extended position.

11. The apparatus of claim 10, wherein the first and second stationary connectors are substantially parallel to the first and second moveable connectors when the first and second moveable connectors are in the extended position.

12. The apparatus of claim 11, wherein the first and second stationary connectors are substantially perpendicular to the third moveable connector when the third moveable connector is in the extended position.

13. The apparatus of claim 10, wherein the first and second moveable connectors are each in the retracted position and the third moveable connector is in the extended position for disconnecting electrical power at a residential service location.

14. The apparatus of claim 10, wherein the first and second moveable connectors are in the extended position and the third moveable connector is in the retracted position for disconnecting electrical power at a commercial service location.

* * * * *